United States Patent [19]

Burton

[11] 4,055,234

[45] Oct. 26, 1977

[54] SKATEBOARD WITH BRAKE

[76] Inventor: Elwin E. Burton, 6530 SE. 89th Ave., Portland, Oreg. 97266

[21] Appl. No.: 709,726

[22] Filed: July 29, 1976

[51] Int. Cl.[2] ..... B60T 1/04

[52] U.S. Cl. ..... 188/2 R; 188/19; 280/11.2

[58] Field of Search ..... 188/2 R, 19–22, 188/29, 74; 280/11.2

[56] References Cited

U.S. PATENT DOCUMENTS 1,933,421 10/1933 Elliotte ..... 188/2 R

*Primary Examiner*—Duane A. Reger

*Attorney, Agent, or Firm*—Eugene M. Eckelman

[57] ABSTRACT

A pair of brake shoes are secured to a cross frame which is supported behind the rear wheels of a skateboard by a slide member having longitudinal guided movement on the bottom of the skateboard. The slide member is connected to one end of a spring steel strip or link secured at its other end to the skateboard. A vertically movable post-like brake pedal is supported in a bore in the skateboard and has abutting engagement at its lower end against an intermediate portion of the spring steel strip whereby upon depressing the brake pedal, the spring steel strip is bowed downwardly to pull the slide forwardly and cause the brake shoes to engage the wheels. When the brake pedal is released, the resiliency in the spring steel strip causes the slide member and slide to retract. The brake pedal is removably mounted in the skateboard for ready detachment therefrom, and the brake shoes are adjustable to compensate for wear after repeated use.

2 Claims, 3 Drawing Figures

SKATEBOARD WITH BRAKE

BACKGROUND OF THE INVENTION

This invention relates to new and useful improvements in skateboard constructions having a brake mechanism in combination therewith.

Skateboards have heretofore been constructed with brake mechanisms in an attempt to reduce the danger which is inherent in skateboard riding. One such prior structure is shown in U.S. Pat. No. 3,288,251 wherein a brake pedal is disposed adjacent to the rearward end of the skateboard and has connection by means of depending levers to move brake shoes onto the rear wheels. This structure and other structures have certain disadvantages, one of which comprises the difficulty of adapting them to the conventional type of skateboard. Another disadvantage of prior structures is that it is difficult for the skateboard rider to apply the brakes since he must step backwards or otherwise change his balance, thus possibly causing him to lose control. Another disadvantage of prior structures is that it is difficult to apply an even braking pressure thereto.

SUMMARY OF THE INVENTION

According to the present invention and forming a primary objective thereof, a brake mechanism is provided which is readily adaptable to conventional type skateboards and which facilitates better braking of the skateboard than structures of the prior art to decrease the hazards of skateboard riding.

To carry out the objectives of the invention, a brake actuating slide is supported on the bottom of the skateboard for longitudinal movement and has connection to a longitudinally extending link anchored at its forward end to the skateboard. The link has the characteristics of spring steel, and a brake pedal in the form of a vertical post has slidable engagement in the skateboard body at about the longitudinal center of the skateboard and has abutting engagement against the link to bow it downwardly which causes the slide to move into brake actuating position.

The invention will be better understood and additional objects and advantages will become apparent from the following description taken in connection with the accompanying drawings.

DETAILED DESCRIPTION OF A PREFERRED EMBODIMENT

Figures 1, 2, 3, 4:
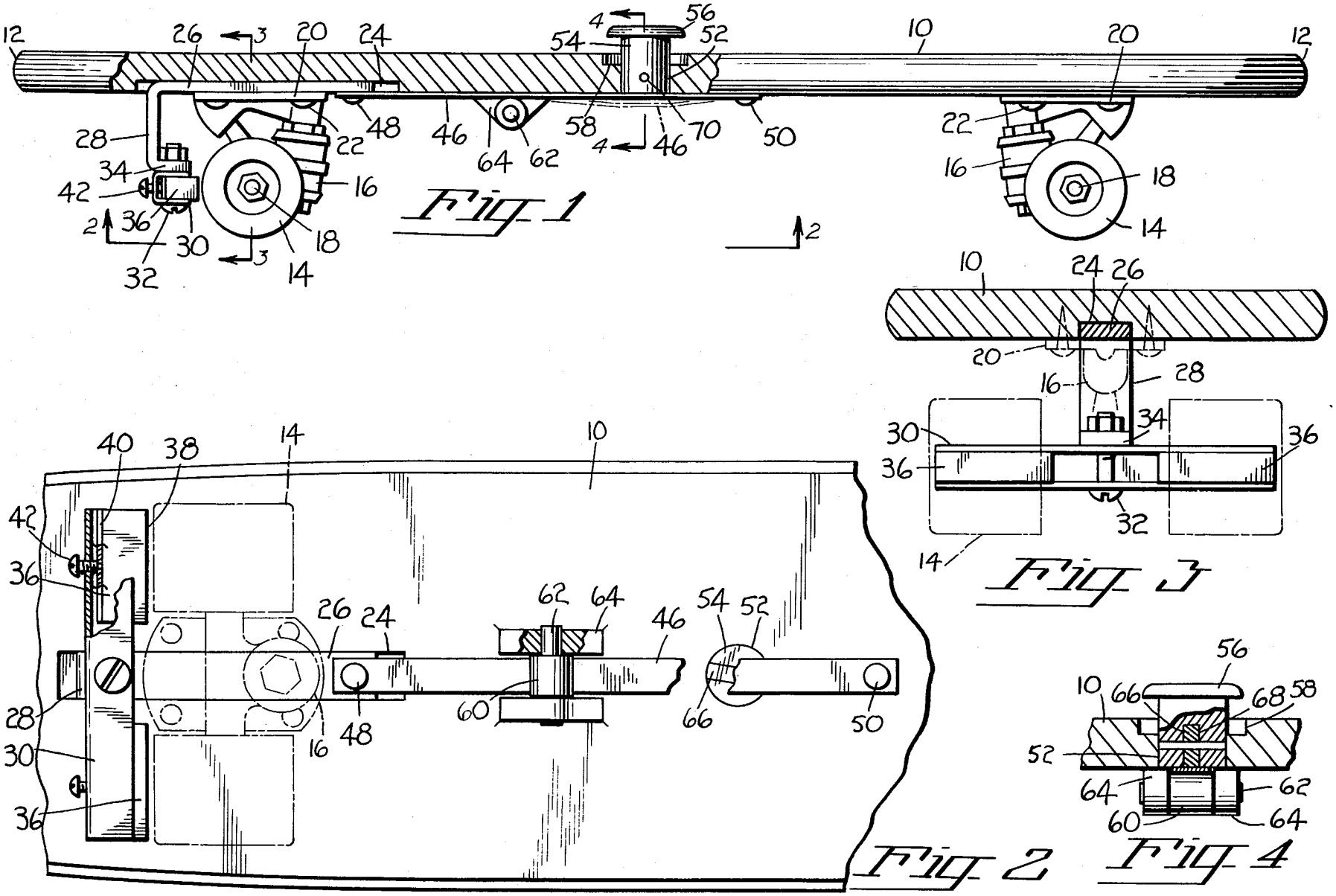
FIG. 1 is a side elevational view, partly broken away, of a skateboard and brake mechanism embodying principles of the present invention.
FIG. 2 is an enlarged fragmentary bottom plan view taken on the line 2—2 of FIG. 1, a wheel assembly of the skateboard being shown in broken lines.
FIG. 3 is an enlarged cross sectional view taken on the line 3—3 of FIG. 1; a wheel assembly of the skateboard also being shown in broken lines.
FIG. 4 is an enlarged fragmentary sectional view taken on the line 4—4 of FIG. 1.

Referring in particular to the drawings, the numeral 10 designates the body member of a skateboard. The body member 10 as in conventional constructions is formed of a plate-like material with an elongated dimension having rounded ends 12. The body member has front and rear wheel assemblies or trucks 14 with a steerable cushioning structure 16 for supporting axles 18. The wheel assemblies have an integral top plate 20 suitably secured to the undersurface of the skateboard, as by screws 22.

According to the present invention, a longitudinal groove 24 is provided in the bottom surface of body member 10 and forms a guideway together with the top plate 20 of the rear wheel assembly for a bar-like slide member 26. Groove 24 is longer than the slide member to allow longitudinal movement of the latter, as will be more apparent hereinafter.

The slide member 26 has a rear right angle depending arm 28 which is vertically rigid and which supports a channel-shaped cross frame 30 at its lower end. The opening of the channel-shaped cross frame 30 faces forwardly and the support of the cross frame on the bottom of the depending arm is by means of a pivot member 32 which engages the cross frame 30 at about the transverse center thereof. This pivot member passes down through a horizontal flange 34 provided on the depending arm 28 and through upper and lower walls of the cross frame 30. The pivot support of the cross frame allows the latter to pivot sideways for a reason which will be more apparent hereinafter.

Disposed in the channel-shaped cross frame are a pair of brake shoes 36 having a forward braking surface 38 adapted for engagement with the wheels 14. A rigid backing plate 40 is provided at the rearward or inner surface of the brake shoes, and adjustment screws 42 are threadedly supported in the cross frame for end abutment with the plates 40 whereby the brake shoes can be individually adjusted in a forward direction for taking up any wear that may occur in the brake shoes or the skateboard wheels.

A pull link 46 is connected at its rearward end, as by a screw 48, the front end of slide member 26, and the front end of such link is anchored as by a screw to the skateboard. The skateboard has a bore 52 disposed substantially centrally thereof between its forward and rearward ends but rearwardly of anchor point 50, and this bore slidably receives a post-like brake pedal 54 having a bottom end which abuts against the upper surface of link 46. When the brake pedal is depressed by the rider, the link 46 is bowed downwardly, as seen in broken lines in FIG. 1, so as to pull the slide member 26 forwardly and engage the brake shoes against the wheels. Brake pedal 54 has a top enlargement 56 which provides a good surface for foot engagement by the rider, and to accommodate such enlargement in a downward position of the brake pedal, the upper surface of the skateboard has a notch 58 which receives the enlargement.

Link 46 may comprise a strip of spring steel or other material having the characteristics of spring steel, namely it being desired that it have a sufficient tensile strength to withstand the pull thereon and yet be flexible so that it wll bow downwardly. Such a strip must also have a resilience or spring effect such that when the brake pedal is released it will return to its normal straight position to raise the brake pedal and also push the slide member 26 rearwardly to disengage the brakes.

A guide roller 60 is located between the slide member 26 and the brake pedal 54 and has rotatable support on a cross shaft 62 mounted at its ends in depending ears 64. This roller holds the link up against the bottom surface of the body member but at the same time allows the link 46 to move freely thereby. Since the roller holds the link up against the bottom surface of the body member it urges the return of the link to its normal position from its downward bowed position.

It is preferred that the brake pedal be readily detachable from the skateboard so that it is not in the way when not needed, and for this purpose a magnet 66, best seen in FIG. 4, is mounted in a notch 68 in the bottom of such brake pedal and retained in place by a cross pin 70. This magnet holds the brake pedal in place during normal operation, but the brake pedal can be detached merely by forcefully pulling it out of the board.

According to the present invention, a skateboard is provided which utilizes a brake that is readily adaptable to conventional type skateboards. In addition, the brake structure of the board is convenient in its operation and can be operated by either foot. The central location of the brake pedal also allows the rider to maintain control of the skateboard during a braking operation. The pivoted support of the brake shoe holder 30 allows it to pivot with the wheels 14 if such wheels are used in turning the board.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A skateboard comprising a. an elongated rigid body member having forward and rearward ends and also having top and bottom surfaces, b. wheel assemblies on the bottom of said body member adjacent each end, c. each of said wheel assemblies having a pair of wheels, d. a slide member mounted on the bottom side of said body member for longitudinal adjustable movement, e. a cross frame support, f. brake shoe means on said cross frame support adjacent to said wheels, g. a single vertically disposed pivot means connecting said cross frame support to said slide member whereby said cross frame support and said brake shoe means can pivot with side turning of the wheels, h. an upright brake pedal extending through said body member and having an upper foot engaging portion, i. and link means operative by said brake pedal providing longitudinal movement of said slide member to engage the brake shoes against the wheels upon a brake actuating movement of said brake pedal.

2. The skateboard of claim 1 wherein said link means comprises a spring steel metal strip and extends along the bottom surface of said body member with one end secured to said slide member and the other end secured to said body member and said brake pedal in being applied in a downward direction abuts against said link means intermediate its ends to bow said link means downwardly and draw said slide member toward brake actuating position, said link means having spring characteristics whereby upon disengagement thereof by said brake pedal the resiliency thereof returns the brake pedal and slide member to a non-braking position, said brake pedal having a magnet attached to the bottom end thereof for detachably securing said brake pedal to said link means for ready removal of said brake pedal from the skateboard.

* * * * *